US007316658B2

(12) United States Patent
Gagne

(10) Patent No.: US 7,316,658 B2
(45) Date of Patent: Jan. 8, 2008

(54) SINGLE PATIENT USE VEST

(75) Inventor: Donald J. Gagne, St. Paul, MN (US)

(73) Assignee: Hill-Rom Services, Inc., Wilmington, DE (US)

( * ) Notice: Subject to any disclaimer, the term of this patent is extended or adjusted under 35 U.S.C. 154(b) by 672 days.

(21) Appl. No.: 10/657,728

(22) Filed: Sep. 8, 2003

(65) Prior Publication Data

US 2005/0054956 A1 Mar. 10, 2005

(51) Int. Cl.
*A61H 31/00* (2006.01)

(52) U.S. Cl. ..... 601/41; 601/DIG. 7; 601/DIG. 11

(58) Field of Classification Search ..... 601/41, 601/44, 140, 151, 152; 137/798, 799; 251/149; 285/3, 192, 193
See application file for complete search history.

(56) References Cited

U.S. PATENT DOCUMENTS

| | | | | |
|---|---|---|---|---|
| 402,779 | A | | 5/1889 | Steinhoff |
| 1,367,420 | A | | 2/1921 | Munter |
| 1,646,590 | A | | 10/1927 | Mildenberg et al. |
| 1,952,695 | A | * | 3/1934 | Webb et al. ..... 174/151 |
| 2,338,535 | A | | 1/1944 | Pfleumer |
| 2,354,397 | A | | 7/1944 | Miller |
| 2,436,853 | A | | 3/1948 | Coleman |
| 2,486,667 | A | | 11/1949 | Meister |
| 2,529,258 | A | | 11/1950 | Lobo |
| 2,543,284 | A | | 2/1951 | Gleason |
| 2,588,192 | A | | 3/1952 | Akerman et al. |
| 2,762,366 | A | | 9/1956 | Huxley, III et al. |
| 2,772,673 | A | | 12/1956 | Huxley, III et al. |
| 2,779,329 | A | | 1/1957 | Huxley, III et al. |
| 2,780,222 | A | | 2/1957 | Polzin et al. |
| 2,818,853 | A | | 1/1958 | Huxley, III et al. |
| 2,832,335 | A | | 4/1958 | Huxley, III et al. |
| 2,869,537 | A | | 1/1959 | Chu |
| 2,899,955 | A | | 8/1959 | Huxley, III et al. |
| 3,043,292 | A | | 7/1962 | Mendelson |
| 3,063,444 | A | | 11/1962 | Jobst |
| 3,120,228 | A | | 2/1964 | Huxley, III |
| 3,266,070 | A | | 8/1966 | O'Link |
| 3,310,050 | A | | 3/1967 | Goldfarb |
| 3,333,581 | A | | 8/1967 | Robinson et al. |
| 3,481,327 | A | | 12/1969 | Drennen et al. |
| 3,566,862 | A | | 3/1971 | Schuh et al. |
| 3,577,977 | A | | 5/1971 | Ritzinger, Jr. et al. |
| 3,683,655 | A | | 8/1972 | White et al. |
| 3,945,041 | A | | 3/1976 | Rhee |
| 3,993,053 | A | | 11/1976 | Grossan |
| 4,344,620 | A | | 8/1982 | Debski |
| 4,349,015 | A | | 9/1982 | Alferness |
| 4,397,306 | A | | 8/1983 | Weisfeldt et al. |
| 4,424,806 | A | | 1/1984 | Newman et al. |

(Continued)

FOREIGN PATENT DOCUMENTS

| | | |
|---|---|---|
| EP | 0542383 | 5/1993 |

(Continued)

*Primary Examiner*—Danton DeMille
(74) *Attorney, Agent, or Firm*—Barnes & Thornburg LLP

(57) ABSTRACT

An improved connector having limited durability for a disposable chest compression vest is quiet and cost effective. Among other advantages, the connector is heat sterilizable and flat so that the vest can be efficiently packaged and stacked, which is particularly beneficial for use in a hospital.

42 Claims, 6 Drawing Sheets

U.S. PATENT DOCUMENTS

| | | | | |
|---|---|---|---|---|
| 4,453,538 | A | | 6/1984 | Whitney |
| 4,483,336 | A | | 11/1984 | Deitch |
| 4,561,853 | A | | 12/1985 | Faulconer et al. |
| 4,577,626 | A | | 3/1986 | Marukawa et al. |
| 4,621,621 | A | | 11/1986 | Marsalis |
| 4,637,074 | A | | 1/1987 | Taheri |
| 4,646,366 | A | | 3/1987 | Nishida et al. |
| 4,676,232 | A | | 6/1987 | Olsson et al. |
| 4,815,452 | A | | 3/1989 | Hayek |
| 4,838,263 | A | | 6/1989 | Warwick et al. |
| 4,840,167 | A | | 6/1989 | Olsson et al. |
| 4,928,674 | A | | 5/1990 | Halperin et al. |
| 4,930,498 | A | | 6/1990 | Hayek |
| 4,971,042 | A | | 11/1990 | Lerman |
| 4,977,889 | A | | 12/1990 | Budd |
| 5,056,505 | A | | 10/1991 | Warwick et al. |
| 5,076,259 | A | | 12/1991 | Hayek |
| 5,101,808 | A | | 4/1992 | Kobayashi et al. |
| 5,188,097 | A | | 2/1993 | Hansen |
| 5,222,478 | A | | 6/1993 | Scarberry et al. |
| 5,261,394 | A | | 11/1993 | Mulligan et al. |
| 5,277,194 | A | | 1/1994 | Hosterman et al. |
| 5,299,599 | A | | 4/1994 | Farmer et al. |
| 5,453,081 | A | | 9/1995 | Hansen |
| 5,455,159 | A | | 10/1995 | Mulshine et al. |
| 5,496,262 | A | | 3/1996 | Johnson, Jr. et al. |
| 5,507,904 | A | | 4/1996 | Fisher et al. |
| 5,548,843 | A | | 8/1996 | Chase et al. |
| 5,562,604 | A | | 10/1996 | Yablon et al. |
| 5,567,916 | A | * | 10/1996 | Napiorkowski et al. 174/153 G |
| 5,569,170 | A | | 10/1996 | Hansen |
| 5,743,884 | A | * | 4/1998 | Hasson et al. ..... 604/167.02 |
| 5,769,797 | A | | 6/1998 | Van Brunt et al. |
| 5,769,800 | A | | 6/1998 | Gelfand et al. |
| 5,806,512 | A | | 9/1998 | Abramov et al. |
| 5,891,062 | A | | 4/1999 | Schock et al. |
| 5,997,488 | A | | 12/1999 | Gelfand et al. |
| 6,030,353 | A | | 2/2000 | Van Brunt |
| 6,155,996 | A | | 12/2000 | Van Brunt et al. |
| 6,210,345 | B1 | | 4/2001 | Van Brunt |
| 6,267,564 | B1 | | 7/2001 | Rapheal |
| 6,340,025 | B1 | | 1/2002 | Van Brunt |
| 6,379,316 | B1 | | 4/2002 | Van Brunt et al. |
| 6,415,791 | B1 | | 7/2002 | Van Brunt |
| 6,471,663 | B1 | | 10/2002 | Van Brunt et al. |
| 6,676,614 | B1 | * | 1/2004 | Hansen et al. ..... 601/41 |
| 2002/0082531 | A1 | | 6/2002 | Van Brunt et al. |

FOREIGN PATENT DOCUMENTS

| | | |
|---|---|---|
| FR | 2507064 | 12/1982 |
| SE | 105158 | 8/1942 |
| SU | 1427009 | 1/1985 |

* cited by examiner

SINGLE PATIENT USE VEST

BACKGROUND OF THE INVENTION

The present invention relates to chest compression devices and in particular to a high-frequency chest wall oscillator device.

Manual percussion techniques of chest physiotherapy have been used for treatment of a variety of diseases in order to remove the excess mucous that collects in the lungs. A non-exhaustive list of such diseases includes cystic fibrosis, emphysema, asthma and chronic bronchitis, to remove the excess mucous that collects in the lungs. To alleviate dependency on a care giver to provide this therapy, chest compression devices have been developed to produce high frequency chest wall oscillation (HFCWO), the most successful method of airway clearance.

The device most widely used to produce HFCWO is THE VEST™ airway clearance system by Advanced Respiratory, Inc. (f/k/a American Biosystems, Inc.), the assignee of the present application. A description of the pneumatically driven system is found in the Van Brunt et al. Patent, U.S. Pat. No. 6,036,662, which is assigned to Advanced Respiratory, Inc. Additional information regarding HFCWO and THE VEST™ system is found on the Internet at www.thevest.com. Other pneumatic chest compression devices have been described by Warwick in U.S. Pat. No. 4,838,263 and by Hansen in U.S. Pat. Nos. 5,543,081; 6,254,556 and 6,547,749.

Pneumatically-driven HFCWO produces substantial transient increases in the air flow velocity combined with a small displacement of the chest cavity volume. This action, in turn, produces a cough-like shear force and a reduction in mucous viscosity which results in an outward motion of the mucous.

Previous non-disposable vests were designed for one person to use multiple times over many years. The durable material that is used makes the vest too expensive to be utilized for short-term use. For hospital use, as an example, generally the patient only uses the vest during one hospital visit. The vest can not be used by multiple patients, because mucous may be expelled onto the vest by each patient, and previous vests could not be sterilized between uses.

Prior art disposable vests are attached to hoses through a connector that presents several problems. The connectors are large and bulky, which prevents efficient packaging and stacking of the vests. The connectors can not be heat sterilized and interfere with x-ray imaging. In addition, the connectors attach to the hose such that air pulses from the hose are forced into and bounce off of the wall of an inflatable air bladder that is part of the vest. This effect can be heard by the patient and those in the vicinity of the patient. Therefore, there is a need for a more cost-effective and quieter vest designed for short-term single-patient use.

BRIEF SUMMARY OF THE INVENTION

The present invention is a connector for connection between an inflatable air bladder and a hose of a chest compression system. The connector is made of a thermoplastic elastomer that provides limited durability to the connector. A slot is formed in the thermoplastic elastomer to form an airtight seal between the air bladder and the hose. The slot is comprised of a slit with holes at its ends which allow for easy insertion of the hose into the slot. Tabs form at the intersection of the slit and the holes, but no air leakage occurs around the holes, because the holes have a diameter that allow the tabs to recede when the slot is stretched open for insertion by the hose.

DETAILED DESCRIPTION

Figure 1:
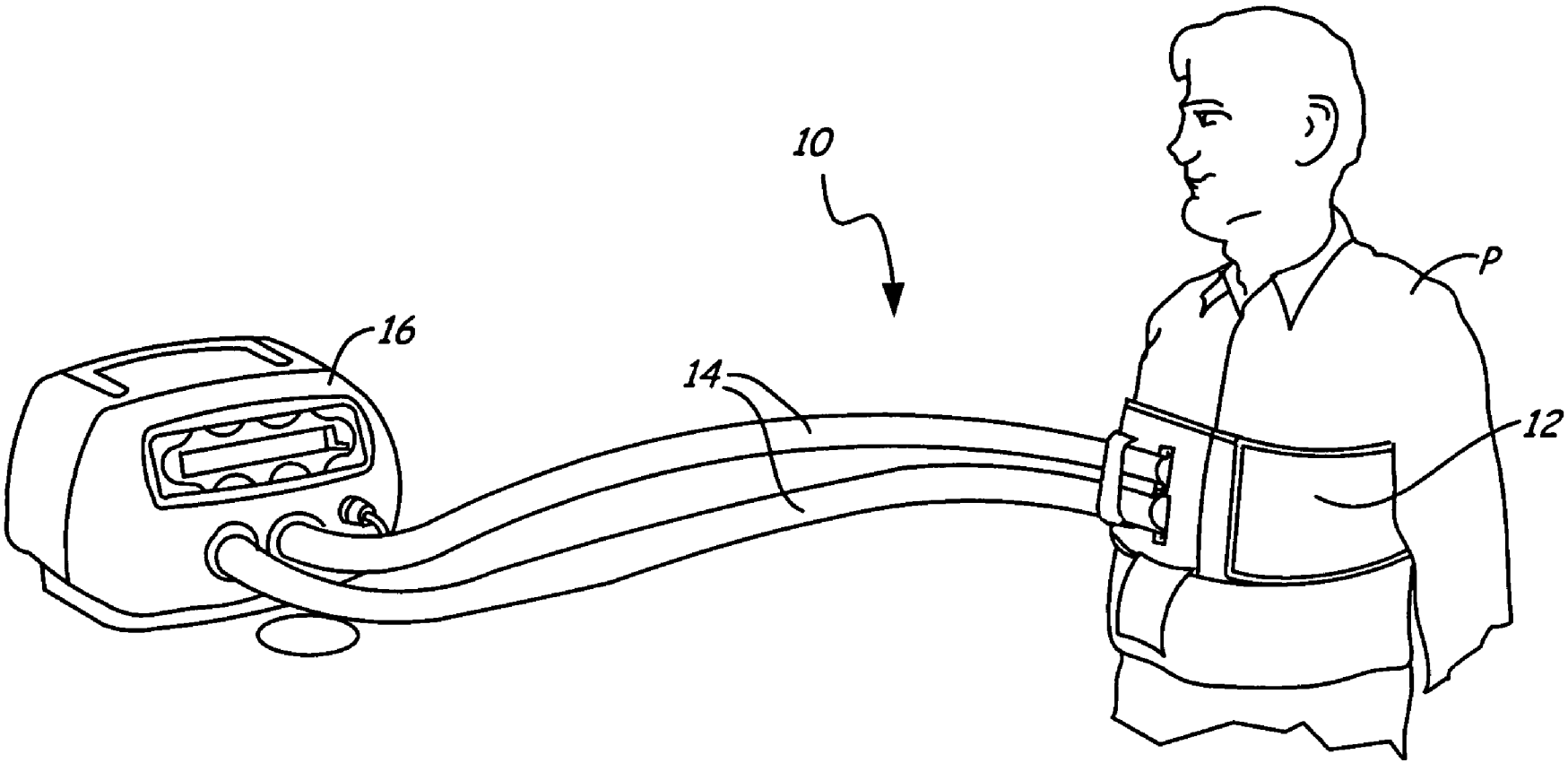
FIG. 1 is a perspective view of a patient undergoing HFCWO using a vest of the present invention.

FIG. 1 shows patient P undergoing HFCWO using a system 10 with a vest 12 of the present invention. System 10 includes vest 12, hoses 14 and air pulse generator 16. Vest 12 fits around the chest of patient P. Hoses 14 connect at one end to vest 12 and at the other end to air pulse generator 16.

During treatment, air pulse generator 16 generates oscillatory air pulses which travel to vest 12 through hoses 14. The result is oscillatory chest compressions delivered to the chest of patient P for clearing mucus from the lungs of patient P.

Figure 2A:
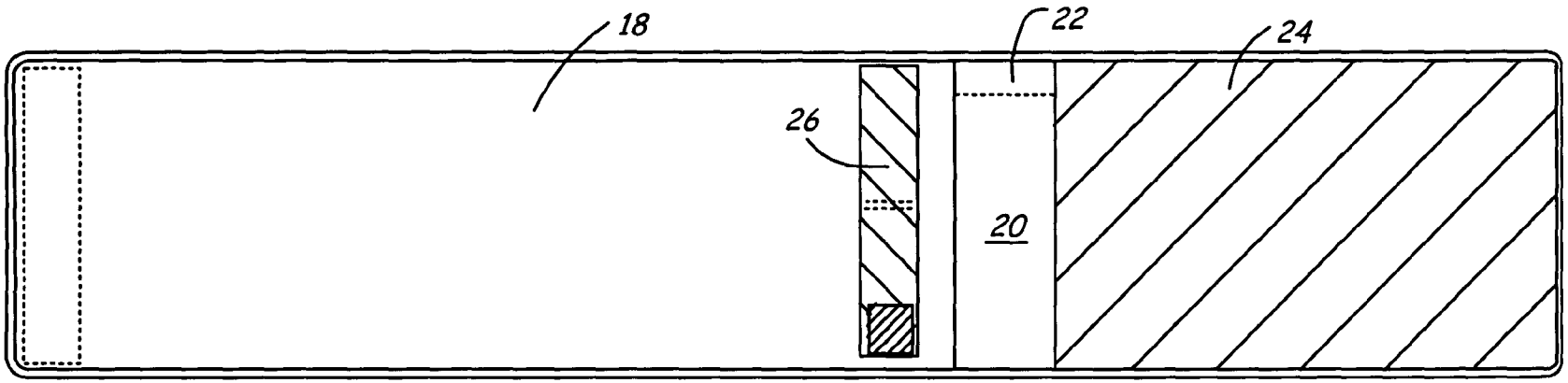
FIG. 2*a* is a view of the outside surface of the vest prior to use.

FIG. 2*a* shows the outside of vest 12 prior to use. Vest 12 includes belt 18, cover 20 with indicia 22, attachment 24 and hose tie 26. Cover 20 spans across the width of belt 18 and is sewn along the top and bottom edges. Cover 20 covers the area where hoses 14 connect to vest 12, which will later be discussed in detail. Indicia 22, shown as a dashed line on cover 20, indicates that cover 20 should be torn or cut prior to use. Attachment 24 is mounted at one end of belt 18 near cover 20. Hose tie 26 is attached on the other side of cover 20 to belt 18.

Figure 2B:
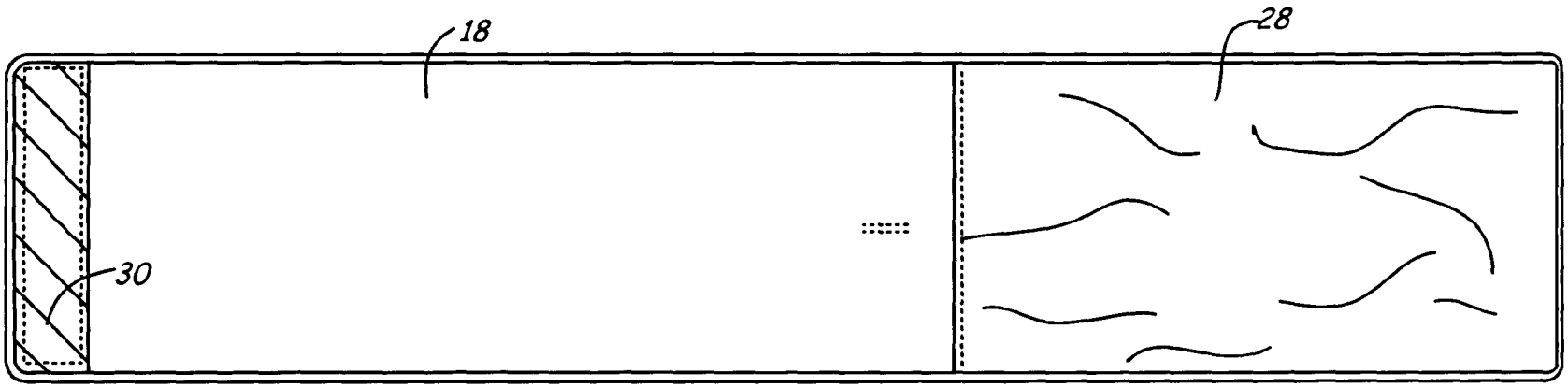
FIG. 2*b* is a view of the inside surface of the vest.

FIG. 2*b* shows the inside of vest 12, which is inverted vertically relative to vest 12 shown in FIG. 2*a*. Vest 12 includes belt 18, air bladder 28 (shaded region) and attachment 30. Air bladder 28 is attached at one end of belt 18 and preferably covers an area that is essentially on the direct opposite side of belt 18 from attachment 24 and cover 20. Attachment 30 is preferably near the opposite end of belt 18 from air bladder 28.

Prior to fitting vest 12 on patient P, cover 20 is checked to verify that cover 20 is intact. This provides indication that vest 12 is unused and has not been tampered with. If cover 20 is torn or cut, vest 12 should not be used. If cover 20 is intact, then it may be torn or cut as indicated by indicia 22. Indicia 22 can be any indicator showing that cover 20 must be torn or cut prior to use.

To fit vest 12 on patient P, belt 18 is wrapped around patient P such that air bladder 28 is on the inside of vest 12 and over the chest of patient P. Attachment 30 is then connected to attachment 24 to secure vest 12 in place. Preferably, attachments 24 and 30 are mates for a hook-and-loop type attachment, but any type of attachment may be used. Either or both of attachment 24 and 30 should be of a relatively large size so the circumference of vest 12 is adjustable to fit many sizes of people.

Figure 3:
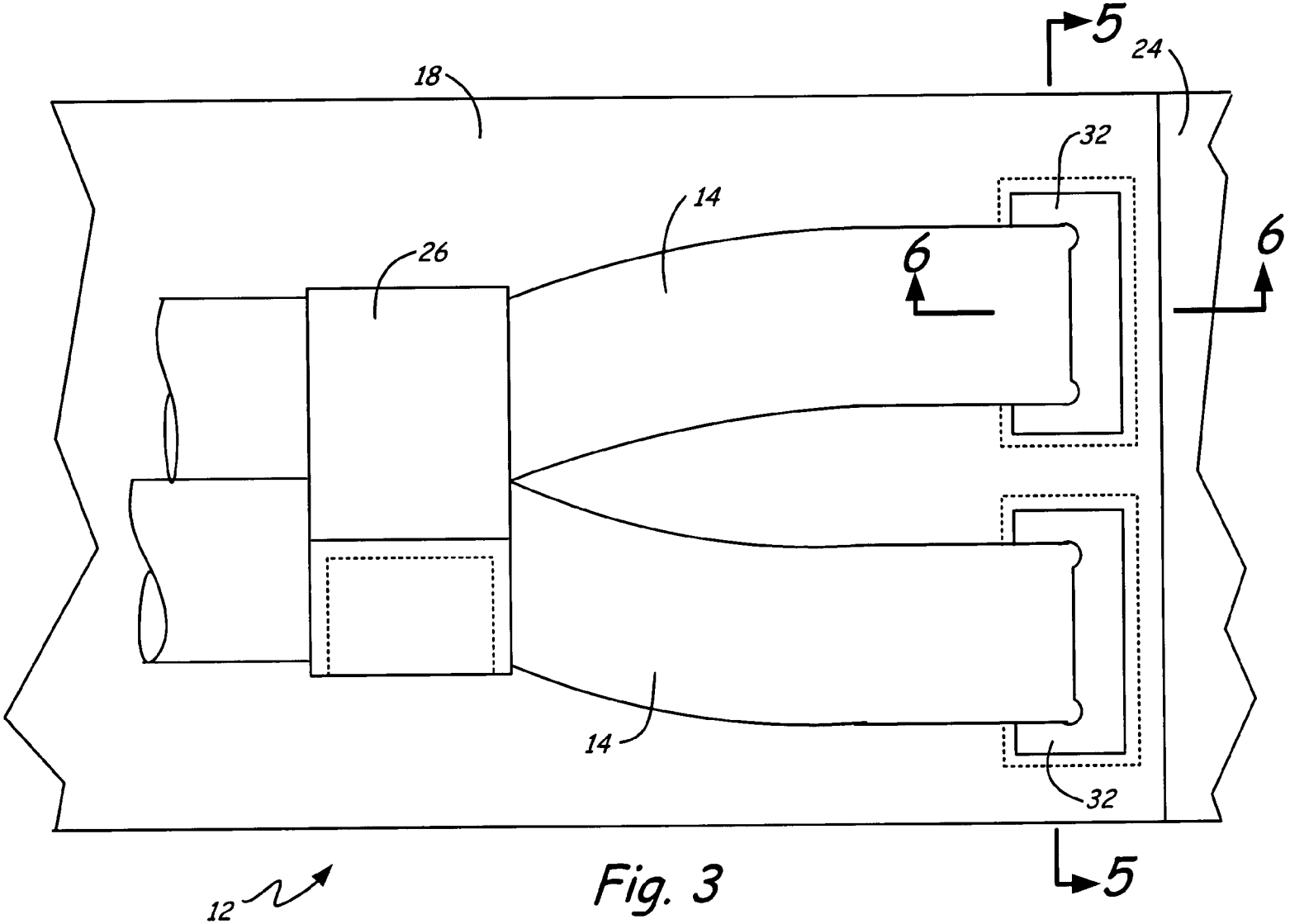
FIG. 3 is a front, cutaway view of the vest showing the hoses attached to the vest.

FIG. 3 shows hoses 14 connected to vest 12. To simplify the drawing, cover 20 is not shown but would be torn or cut at this point. Vest 12 and hoses 14 are shown cutaway. Vest 12 includes belt 18, attachment 24, hose tie 26 and connector 32.

In operation, hoses 14 are connected to vest 12 via connector 32. Hoses 14 are inserted through slots in connector 32 (discussed in detail below) that are in communication with air bladder 28 such that hoses 14 lay along belt 18 and are secured to belt 18 by hose tie 26. The openings of hoses 14 point in a direction essentially parallel to belt 18, the chest of patient P and/or connector 32. Hose tie 26 positions hoses 14 parallel to the same plane. Hose tie 26 is preferably comprised of a loop of hook-and-loop type material, but any type of attachment that secures hoses 14 to belt 18 may be used.

Having hoses 14 angled in this manner allows system 10 to be quieter during treatment compared to prior art disposable vests. Prior art disposable vests use connectors that force air into air bladder 28 at an angle that is essentially perpendicular to belt 18. The oscillatory air pulses that are forced into air bladder 28 bounce off the wall of air bladder 28, which creates noise. With the present invention having hoses 14 angled as described above, the air pulses no longer bounce off the wall of air bladder 28 resulting in a quieter system.

Figure 4A:
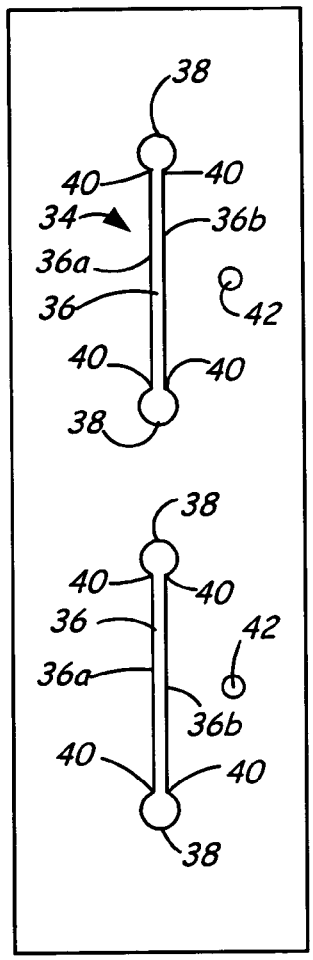
FIG. 4*a* is a front view of the connector.
Figure 4B:
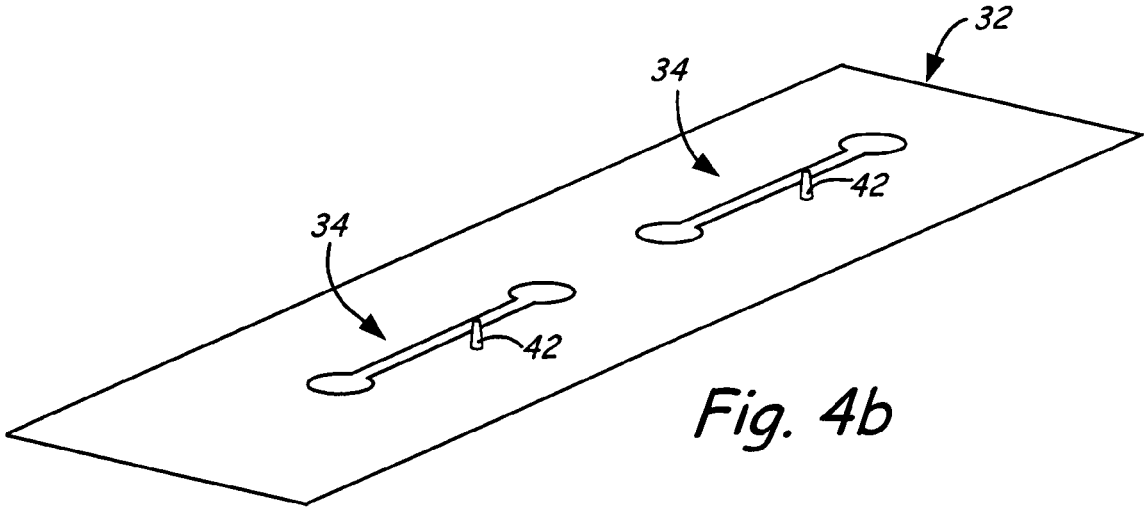
FIG. 4*b* is a perspective view of the connector.

FIG. 4*a* shows connector 32. Connector 32 includes slots 34 with slits 36 having edges 36*a* and 36*b*, holes 38 and tabs 40; and finger grips 42. FIG. 4*b* is a perspective view of connector 32 showing slot 34 and finger grips 42.

Connector 32 is shown in its preferred embodiment having two slots 34. However, connector 32 may have only one slot 34 or more than two depending on the number of hoses 14 which need to be connected to vest 12. Each slot 34 has slit 36 with flaps 36*a* and 36*b* at either side. Holes 38 are at the ends of slit 36 such that slot 34 is a continuous opening between slit 36 and holes 38. Tabs 40 form where flaps 36*a* and 36*b* meet with holes 38. Finger grips 42 are offset from the center of slots 34 and protrude perpendicularly from connector 32.

The openings formed by slots 34 allow hoses 14 to communicate with air bladder 28. To connect hose 14 to vest 12, patient P or someone else grasps finger grip 42 to stretch open slot 34 and inserts hose 14. Finger grip 42 is not required for this invention but makes it easier to insert hose 14 into slot 34. The dimensions and shape of finger grips 42 are not critical as long as they can be grasped. Finger grips 42 are preferably a protrusion of the same material as connector 32 and have a height of about 0.44 in and a diameter of about 0.13 in.

Figure 5:
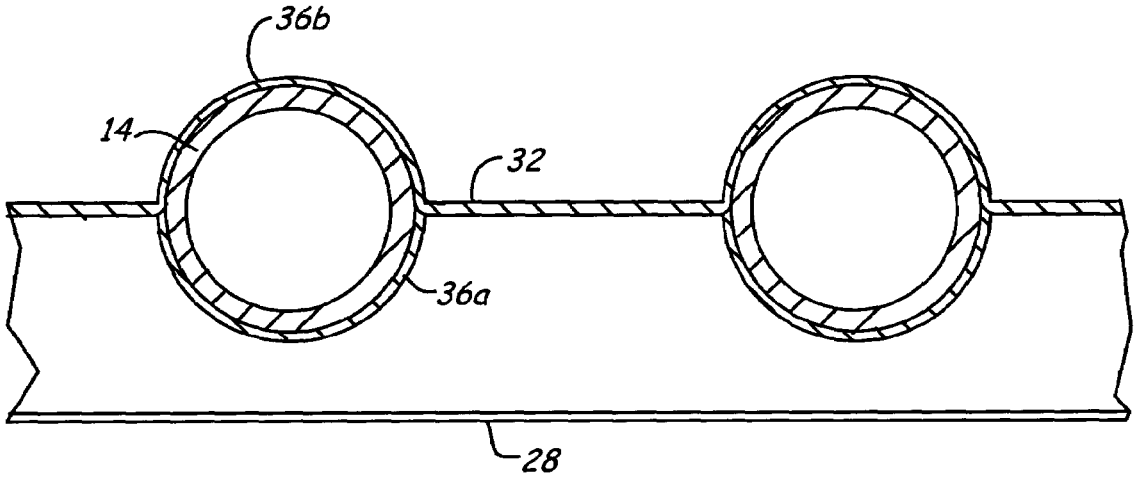
FIG. 5 is a cross section at 5 of FIG. 3 of the hoses inserted into the connector.
Figure 6:
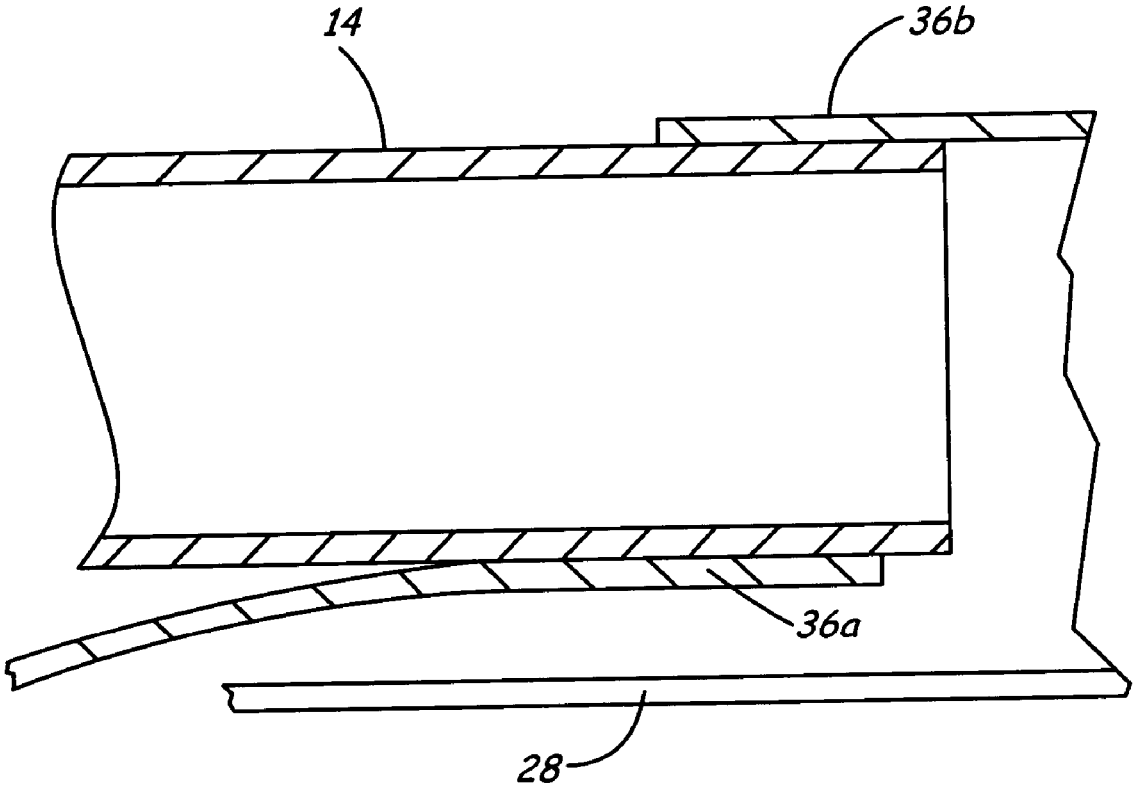
FIG. 6 is a cross section at 6 of FIG. 3 of the hoses inserted into the connector.

FIGS. 5 and 6 are cross sections 5 and 6 of hose 14 inserted through slots 34, as shown in FIG. 3. FIGS. 5 and 6 include hoses 14, air bladder 28, connector 32 and flaps 36*a* and 36*b*. When hose 14 is inserted through slot 34, flap 36*b* stretches over hose 14 and is exposed to the outside. Flap 36*a* stretches under hose 14 and is substantially inside air bladder 28. Connector 32 is substantially part the wall of the air bladder by forming an airtight seal around hose 14.

Holes 38 function to make insertion of hose 14 easier and decreases stress on the material forming the seal. The dimensions of holes 38 relative to the dimensions of slit 36 and hose 14 are a factor in forming an airtight seal. The diameter of holes 38 are such that when hose 14 is inserted into slot 34, slot 34 is stretched to a point where tabs 40 recede. When tabs 40 recede there is no air leakage around slot 34. In the preferred embodiment, a hose having a 1.25 in. outside diameter is inserted. The distance between the centers of holes 38 is about 1.225 in., but the length of slit 36 may vary by up to approximately 5%. The width of the gap between flaps 36*a* and 36*b* is about 0.03 in. but can vary significantly. The diameter of holes 38 is about 0.187 in.

To this end, connector 32 must be made of an elastic sheet material. Latex, however, is not a preferred material for the present invention. Preferably, connector 32 is made from a thermoplastic elastomer, an example of which is 0.060 in. Versaflex CL30 Shore A 29D.

The durometer hardness rating of the material forming connector 32 is also a factor in obtaining an acceptable connector. The preferred material has limited durability, meaning it is durable enough for a single patient to use in the short-term, but since it is inexpensive enough for a cost-effective disposable vest, it will not last through multiple uses over the long-term. The preferred material above has a durometer hardness rating of about 29 on the Shore A scale but can range from about 20 to about 40.

The hardness and thickness of the material forming connector 32 have an inverse relationship, and the dimensions of holes 38 depend on this relationship. If the material is too soft, slot 34 lacks enough tension to form an airtight seal. Increasing the thickness of the material, however, will increase the amount of tension. Likewise, if the material is too hard, slot 34 will not conform to the proper shape change needed to create the seal, but decreasing the thickness of the material allows it to conform to the proper shape. Holes 38 allow more tolerance in varying the hardness and thickness of the material. As discussed above, the dimensions of holes 38 are a factor, but change, for each combination of hardness and thickness of the material. The dimensions are a factor because if holes 38 are too small, stresses and tears occur around slot 34. If holes 38 are too large, slot 34 leaks.

The length of slit 36 and width of the gap between flaps 36*a* and 36*b* can vary somewhat for each combination of hardness and thickness. In fact, the gap can be as small as a cut with a knife blade or large enough that slot 34 more closely resembles an oval. However, an actual oval shape is not preferred, because there is a tendency for gaps to form and leakage to occur where tabs 40 would otherwise be located.

For ease in hospital use, the material should also be able to withstand heat sterilization and not interfere with imaging on x-ray films. Consequently, vest 12 can be sterilized inexpensively, and patient P can wear vest 12 even while being x-rayed. Prior art vests utilized hard plastic connectors that showed through on x-ray films and would melt if heat sterilized. The preferred thermoplastic elastomer above possesses these advantageous qualities.

Lastly, because connector 32 is flat, it makes vest 12 much more cost effective for packaging and storing. Vests 12 can be packaged flat and stacked together. The connectors of prior art disposable vests are relatively large and bulky. Prior art vests cannot be packaged and stacked flat because of the connector. Therefore, a disposable vest having a connector of the present invention overcomes the disadvantages of the prior art connectors to make a quieter and more cost effective chest compression system.

Although the present invention has been described with reference to preferred embodiments, workers skilled in the art will recognize that changes may be made in form and detail without departing from the spirit and scope of the invention.

The invention claimed is:

1. A vest to apply pneumatic pressure delivered by a hose to a chest of a patient, the vest comprising:

a flexible belt including an inflatable bladder; and a connector for connection between the inflatable bladder and the hose, the connector comprising an elastic sheet forming a portion of a wall of the inflatable bladder; and a first slot within the sheet that extends in a direction generally perpendicular to a longitudinal dimension of the belt and that is dimensioned to form an airtight seal around an outer surface of the hose, the elastic sheet having a generally flat configuration along a plane defined by the belt prior to insertion of the hose through the slot, and the elastic sheet being deformable to allow the hose to be inserted through the slot in a direction generally parallel to the plane defined by the belt and generally perpendicular to a longitudinal dimension of the slot.

2. The connector of claim 1 wherein the slot further comprises: a first hole at a first end of the slot; a second hole at a second end of the slot; a first flap on a first side of the slot; a second flap on a second side of the slot; and wherein the holes and flaps stretch to form the continuous airtight seal.

3. The connector of claim 1 and further comprising: a first finger grip.

4. The connector of claim 1 and further comprising: a second slot; and a second finger grip.

5. The connector of claim 1 wherein the elastic sheet is heat sterilizable.

6. The connector of claim 1 wherein the elastic sheet shows no image upon being x-rayed.

7. A vest to apply pneumatic pressure delivered by a hose to a chest of a patient, the vest comprising:

a flexible belt having a generally flat configuration and including an inflatable bladder, the bladder having a generally flat configuration when deflated; and a connector for connection between the inflatable bladder and the hose, the connector comprising a thermoplastic elastomer sheet having a durometer hardness rating that provides limited durability to the connector; a slot within the thermoplastic elastomer sheet that extends in a direction generally perpendicular to a longitudinal dimension of the belt and that is dimensioned to form an airtight seal between the inflatable bladder and the hose, the slot further comprising a slit; holes at ends of the slit; tabs at intersections between the slit and the holes; and wherein no leakage occurs around the holes, because the holes have a diameter that allows the tabs to recede when the slot is stretched open by the hose; the thermoplastic elastomer sheet having a generally flat configuration along a plane defined by the belt prior to insertion of the hose through the slot, and the thermoplastic elastomer sheet being deformable to allow the hose to be inserted through the slot in a direction generally parallel to the plane defined by the belt and generally perpendicular to a longitudinal dimension of the slot.

8. The connector of claim 7 wherein the hose is about 1.25 in.

9. The connector of claim 7 wherein the thermoplastic elastomer has a durometer hardness rating of about Shore A 20 to about Shore A 40.

10. The connector of claim 8 wherein the thermoplastic elastomer has a thickness of about 0.06 inch.

11. The connector of claim 8 wherein the distance between centers of the holes is between about 1.16 in. and about 1.29 in.

12. The connector of claim 8 wherein a distance between the centers of the holes is about 1.23 in.

13. The connector of claim 8 wherein the diameter of the hole is about 0.187 in.

14. The connector of claim 8 wherein the slit has a width of about 0.03 in.

15. The connector of claim 7 and further comprising: a finger grip for pulling the slot open.

16. The connector of claim 15 wherein the finger grip is comprised of the thermoplastic elastomer.

17. The connector of claim 15 wherein a base of the finger grip has a diameter of about 0.13 in and a height of the finger grip is about 0.44.

18. A vest to apply pneumatic pressure delivered by a hose to a chest of a patient, the vest comprising:

a flexible belt having a generally flat configuration including an inflatable bladder, the bladder having a generally flat configuration when deflated; and a connector for connection between the inflatable bladder and the hose, the connector comprising an elastic sheet forming a portion of a wall of the inflatable bladder, the elastic sheet having a durometer hardness rating and a thickness; and a first slot within the sheet that extends in a direction generally perpendicular to a longitudinal dimension of the belt, the slot having dimensions dependent on the durometer hardness and thickness of the sheet and form an airtight seal around an outer surface of the hose, the elastic sheet having a generally flat configuration along a plane defined by the belt prior to insertion of the hose through the slot, and the elastic sheet being deformable to allow the hose to be inserted through the slot in a direction generally parallel to the plane defined by the belt and generally perpendicular to a longitudinal dimension of the slot.

19. The connector of claim 18 wherein the hardness of the sheet and thickness of the sheet have an inverse relationship.

20. The connector of claim 19 wherein the slot further comprises: holes for increasing a range of hardnesses and a range of thicknesses tolerated by the inverse relationship.

21. A pneumatic chest compression vest comprising:

a front panel with an inner and outer surface;

an air bladder on the inner surface;

a belt connected to the front panel for securing the vest;

a connector for connecting the air bladder to a hose, the connector further comprising: an elastic sheet forming a portion of a wall of the inflatable bladder; and a first slot within the sheet dimensioned to form an airtight seal around an outer surface of the hose when the hose is inserted through the slot in a direction generally parallel to the sheet; and an indicator for indicating prior use of the vest and tampering with the vest.

22. The vest of claim 21 wherein the connector further comprises: a second slot.

23. The vest of claim 21 wherein the vest is flat for efficient packaging and stacking for storage.

24. The vest of claim 21 and further comprising: a hose tie.

25. The vest of claim 24 wherein the hose tie positions and secures the hose generally parallel to the sheet.

26. The vest of claim 21 wherein the indicator comprises a cover over the slot.

27. A pneumatic chest compression vest comprising:

a front panel with an inner and outer surface;

an air bladder on the inner surface;

a belt connected to the front panel for securing the vest; and a connector to connect the air bladder to a hose, the connector being comprised of a thermoplastic elastomer having a durometer hardness rating that provides limited durability of the connector, a slot within the thermoplastic elastomer dimensioned to form an airtight seal between the inflatable bladder and the hose, the slot further comprising: a slit; holes at ends of the slit for easy insertion of the hose into the slot; tabs at the intersection of the slit and the holes; and wherein no leakage occurs around the holes, because the holes have a diameter that allows the tabs to recede when the slot is stretched open; and an indicator for indicating prior use of the vest and tampering with the vest.

28. The vest of claim 27 and further comprising: a second slot in the connector to receive a hose.

29. The vest of claim 27 wherein hose connects to the connector at an angle that is less than perpendicular to the front panel.

30. The vest of claim 27 wherein the vest is heat sterilizable.

31. The vest of claim 27 wherein the vest is flat for more efficient packaging and storage.

32. The vest of claim 27 and further comprising: a hose tie for securing the hose to the vest.

33. The vest of claim 27 wherein the indicator comprises a cover over the slot.

34. The vest of claim 27 wherein the vest can be worn by a user while being x-rayed.

35. A chest wall oscillation system comprising:

an air pulse generator;

a hose; and a vest comprising:

a flexible belt including an inflatable bladder; and a connector for connecting the hose to the inflatable bladder, the connector comprising an elastic sheet forming a portion of a wall of the inflatable bladder; and a first slot within the sheet that extends in a direction generally perpendicular to a longitudinal dimension of the belt and that is dimensioned to form an airtight seal around an outer surface of the hose, the elastic sheet having a generally flat configuration along a plane defined by the belt prior to insertion of the hose through the slot, and the elastic sheet being deformable to allow the hose to be inserted through the slot in a direction generally parallel to the plane defined by the belt and generally perpendicular to a longitudinal dimension of the slot.

36. A chest wall oscillation system comprising:

an air pulse generator;

a hose; and a vest comprising:

a flexible belt including an inflatable bladder coupled to the belt; and a connector for connecting the hose to the inflatable bladder, the connector comprising a thermoplastic elastomer sheet having a durometer hardness rating that provides limited durability of the connector, a slot within the thermoplastic elastomer sheet that extends in a direction generally perpendicular to a longitudinal dimension of the belt and that is dimensioned to form an airtight seal between the inflatable bladder and the hose, the slot further comprising: a slit; holes at ends of the slit for easy insertion of the hose into the slot; tabs at the intersection of the slit and the holes; and wherein no leakage occurs around the holes, because the holes have a diameter that allows the tabs to recede when the slot is stretched open by the hose; the thermoplastic elastomer sheet having a generally flat configuration along a plane defined by the belt prior to insertion of the hose through the slot, and the thermoplastic elastomer sheet being deformable to allow the hose to be inserted through the slot in a direction generally parallel to the plane defined by the belt and generally perpendicular to a longitudinal dimension of the slot.

37. The chest wall oscillation system of claim 36 wherein the hose connects to the connector at an angle that is less than perpendicular to the patient's chest such that the air pulses travel in a direction that is generally parallel to the chest region of the patient.

38. A method of connecting a hose to an inflatable bladder, the method comprising:

stretching open a slot within an elastic sheet that forms a portion of a wall of the inflatable bladder by pulling a finger grip to stretch open the slot; and inserting the hose into the slot that is dimensioned such that an airtight seal forms around an outer surface of the hose when the hose is inserted through the slot in a direction generally parallel to the sheet.

39. The method of claim 38 and further comprising: securing the hose with hose ties.

40. The method of claim 38 and further comprising: supplying oscillating air pulses to the hose.

41. The method of claim 40 and further comprising: positioning the inflatable bladder on a chest of a patient; and applying high frequency chest wall oscillations to the patient.

42. A vest to apply pneumatic pressure delivered by a hose to a chest of a patient, the vest comprising:

a belt;

an air bladder coupled to the belt;

a connector for connecting the air bladder to the hose, the connector comprising an elastic sheet forming a portion of a wall of the inflatable bladder, the elastic sheet having a first slot sized to receive the hose therein; and an indicator covering the slot, the indicator indicating whether prior use of the vest has occurred.

* * * * *